US010392840B2

(12) United States Patent
Benhammou

(10) Patent No.: US 10,392,840 B2
(45) Date of Patent: Aug. 27, 2019

(54) ANTI-REMANENT DEVICE FOR AN ELECTROMAGNETIC DOOR LOCK

(71) Applicant: CDVI DIGIT, Pantin (FR)

(72) Inventor: Jacob Benhammou, La Queue en Brie (FR)

(73) Assignee: CDVI DIGIT, Pantin (FR)

( * ) Notice: Subject to any disclaimer, the term of this patent is extended or adjusted under 35 U.S.C. 154(b) by 693 days.

(21) Appl. No.: 14/603,507

(22) Filed: Jan. 23, 2015

(65) Prior Publication Data

US 2015/0211270 A1 Jul. 30, 2015

(30) Foreign Application Priority Data

Jan. 24, 2014 (FR) ..... 14 00153
Mar. 10, 2014 (FR) ..... 14 00578

(51) Int. Cl.

| | |
|---|---|
| ***E05C 17/56*** | (2006.01) |
| ***E05C 19/16*** | (2006.01) |
| ***H01F 7/18*** | (2006.01) |
| ***H01H 47/22*** | (2006.01) |
| ***E05B 47/00*** | (2006.01) |

(52) U.S. Cl.

CPC ..... *E05C 17/56* (2013.01); *E05C 19/166* (2013.01); *H01F 7/1811* (2013.01); *H01H 47/22* (2013.01); *E05B 2047/0048* (2013.01); *Y10T 292/11* (2015.04)

(58) Field of Classification Search

CPC ..... E05C 17/56; E05C 19/166; H01H 47/22; H01F 7/1811; Y10T 292/11; E05B 2047/0048

USPC ..... 361/156

See application file for complete search history.

(56) References Cited

U.S. PATENT DOCUMENTS 3,558,997 A 1/1971 Derc Roman
4,246,621 A * 1/1981 Tsukioka ..... F16K 31/0675 361/111
4,318,155 A 3/1982 Thomas
(Continued)

FOREIGN PATENT DOCUMENTS

EP 0 045 197 A1 2/1982
EP 0 554 940 A1 8/1993
(Continued)

OTHER PUBLICATIONS

French Search Report (FR 1400153) (2 pages—dated Nov. 21, 2014).
French Search Report (FR 1400578) (2 pages—dated Nov. 21, 2014).

*Primary Examiner* — Kevin J Comber
(74) *Attorney, Agent, or Firm* — Renner Kenner Greive Bobak Taylor & Weber

(57) ABSTRACT

Device forming an electromagnetic lock comprising an electromagnetic suction pad (3) comprising an electromagnet (4), a counter plate (1) and an electric circuit comprising a current source designed to supply at least one coil of the electromagnet of the electromagnetic suction pad with an electric magnetization current to create an electromagnetic field and an associated electromagnetic force pinning the counter plate and the electromagnetic suction pad against one another to close the lock; switching means designed to cut off the supply of current; and anti-remanent means for dealing with the remanent electromagnetic force which remains when the switching means have disconnected the supply of current to the electromagnetic coil.

14 Claims, 2 Drawing Sheets

(56) References Cited

U.S. PATENT DOCUMENTS

| | | | | |
|---|---|---|---|---|
| 4,682,801 | A | 7/1987 | Cook et al. | |
| 2004/0175561 | A1* | 9/2004 | Duff, Jr. | G03G 5/0202<br>428/317.9 |
| 2007/0017770 | A1* | 1/2007 | Oh | H01R 13/6666<br>192/84.961 |
| 2009/0262479 | A1* | 10/2009 | Yang | F02D 41/20<br>361/154 |

FOREIGN PATENT DOCUMENTS

| | | | |
|---|---|---|---|
| EP | 1 746 708 | A2 | 1/2007 |
| FR | 2 609 353 | A1 | 7/1988 |
| SU | 520 631 | A1 | 7/1976 |

* cited by examiner

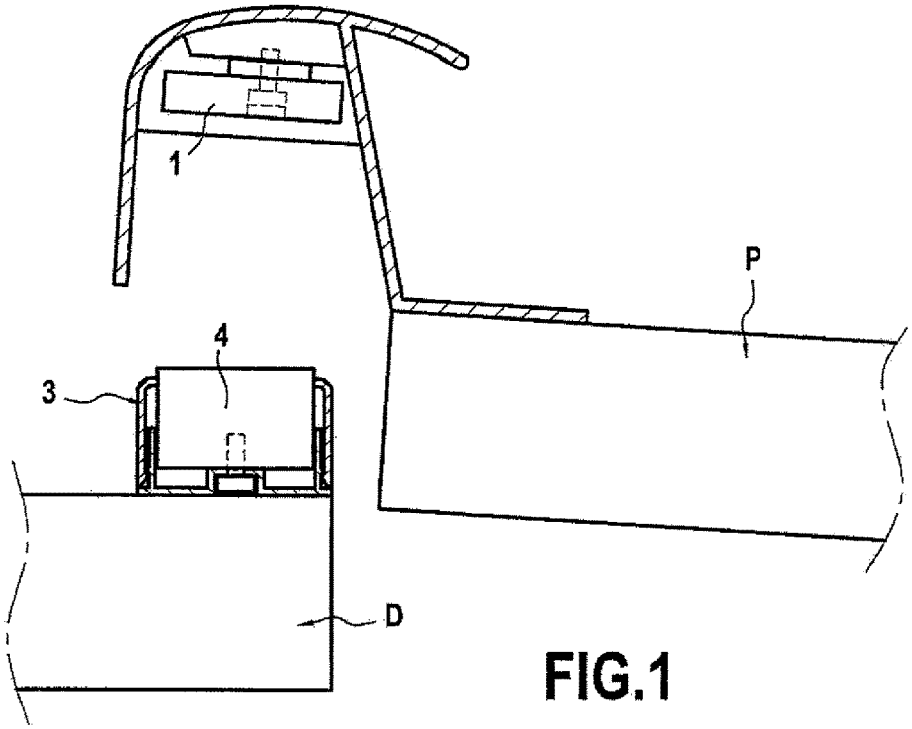
FIG.1
FIG.2
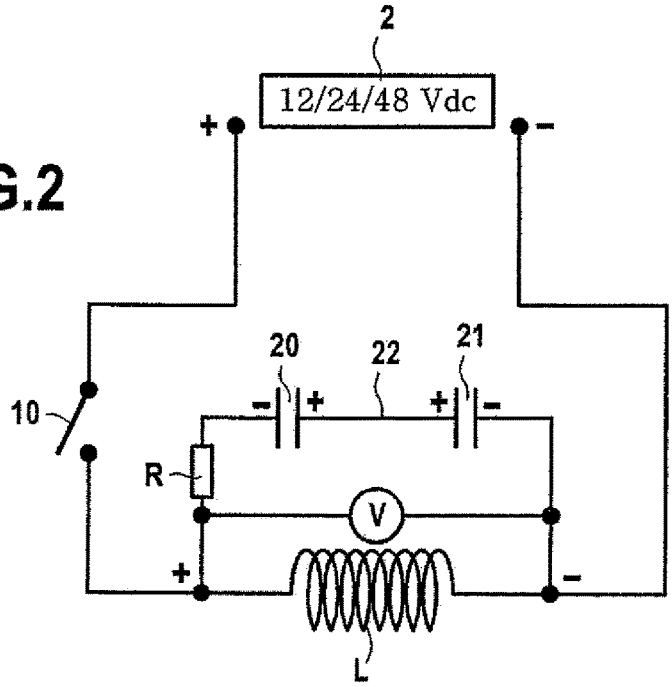

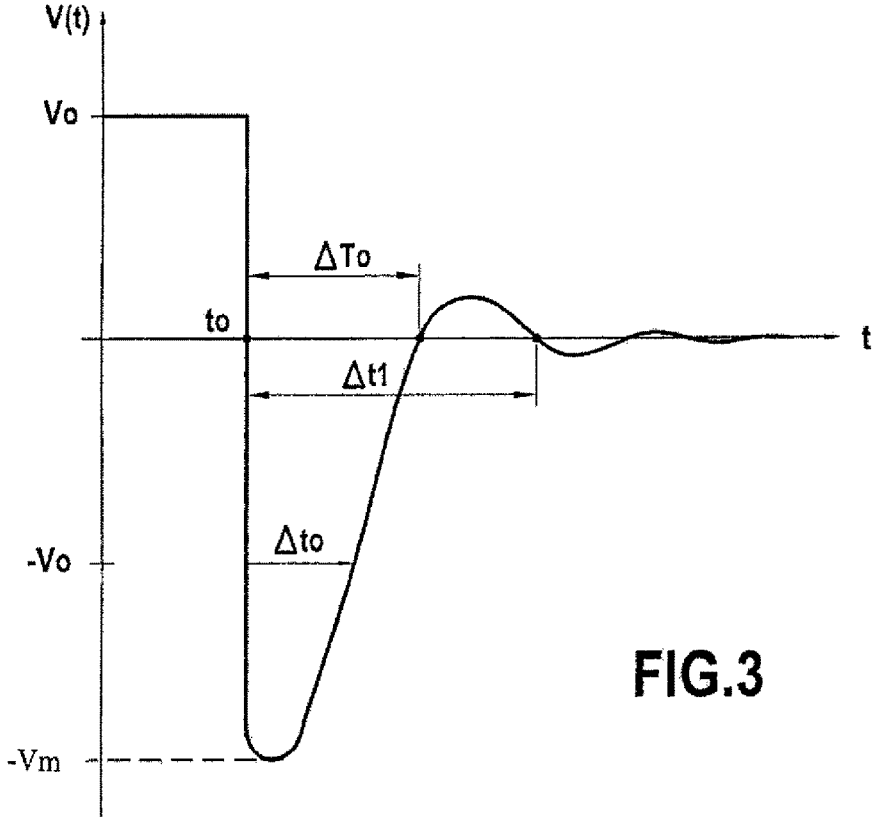
FIG.3
FIG.4
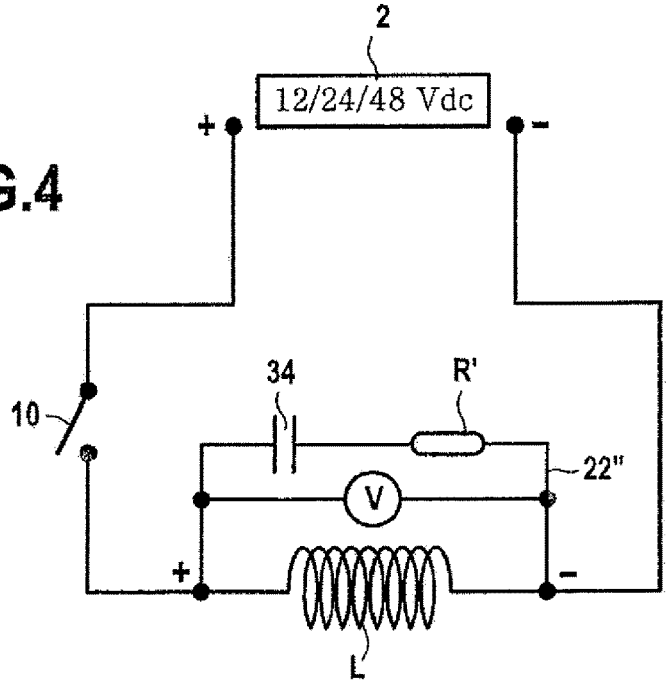

ANTI-REMANENT DEVICE FOR AN ELECTROMAGNETIC DOOR LOCK

The present invention relates to a device forming an electromagnetic lock for controlling the opening/closing of an opening adapted to the casing of a door frame, in particular a door.

This type of device typically comprises an electromagnetic suction pad comprising an electromagnet, generally in the form of a parallelepiped, in particular a rectangle, or prism, received in a two part profile, each part being formed by a U-shaped profile, the two U-shaped profiles slotting into one another and mounting therein the electromagnet and also a counter plate made from a material which is able to be attracted by a magnet, in particular a ferromagnetic material, for example a metal material.

In general, the counter plate is received in a band profile mounted along the free edge of the openable part, generally a door, whereas the electromagnetic suction pad is received in the casing, generally the frame of the door. However, a reverse arrangement is also possible.

Said devices forming the electromagnetic lock have the disadvantage in particular of producing a remanence effect, so that when the electromagnetic lock is deactivated, for example by pressing on the button of the opening, the magnetic action keeps the door closed by means of the magnetic attraction of the counter plate to the suction pad and the user is not able to open the door without having to apply a sufficiently large force to overcome the magnetic force associated with the remanent magnetic field, i.e. the magnetic field which persists despite deactivating the cause of its creation, namely the activation current.

To solve this problem devices of the prior art have proposed inserting an anti-remanent electric circuit to send an electric current into the coil of the electromagnet in the reverse direction of the electric magnetisation current.

Said devices of the prior art have a complex structure and are expensive to manufacture. In particular, they comprise complex electronic components, such as relays, in particular bistable or DPDT type relays, transistors, or the like. Said devices are also not very reliable and often break down, particularly when used for a door system designed to have a long life cycle, for example in the case of an access door to public places. Furthermore, said anti-remanent electric circuits of the prior art only function in a single direction of polarity of the source of current, complicating their use in the door system.

Mechanical solutions have also been proposed. An anti-remanent device has been proposed which consists of a lug received in a blind bore formed on the surface of the counter plate for example and which projects from the hole, being mounted there movably so as to be pushed by a spring arranged at the bottom of the blind bore which pushes the lug out of the hole. When the counter plate and the suction pad come into mutual contact from the effect of the electromagnetic force closing the lock, the lug, despite the spring, is pushed completely inside the hole. When the magnetic field is deactivated, there is still a remanent electromagnetic force which is smaller than the magnetic force in the activated state, and in particular is smaller than the thrust of the spring on the lug, the spring constant having been previously selected for this purpose. Then the lug comes out of the hole and pushes away the suction pad, which enables the user to open the door, the remanent electromagnetic force having been overcome by the action of the lug pushed by the spring.

Said devices of the prior art are complicated to manufacture. Furthermore, because of wear, particularly as a result of corrosion, they have a limited lifetime. Furthermore, the thrust action of the lug into the hole by electromagnetic force in the activated state reduces the magnetic force available for pinning the two elements of the electromagnetic lock against one another.

The present invention aims to overcome the disadvantages of the prior art by proposing a device of the above kind which has a simpler and more reliable structure.

According to the invention, a device forming an electromagnetic lock comprising an electromagnetic suction pad comprising an electromagnet, a counter plate and an electric circuit comprising a source of current designed to supply at least one coil of the electromagnet of the electromagnetic suction pad with an electric magnetisation current to create an electromagnetic field and an associated electromagnetic force pinning the counter plate and the electromagnetic suction pad against one another to close the lock; switching means designed to disconnect the current supply; and anti-remanent means for dealing with the remanent electromagnetic force which is still present when the switching means have disconnected the supply of current to the coil of the electromagnet, is characterised in that the electric circuit is set up such that the source of current is mounted directly at the terminals of the at least one coil such that when the switching means disconnects the supply of current, a disconnection voltage in the form of a pulse, in particular a negative pulse, appears at the terminals of the coil and the electric circuit comprises means for delaying the switchover to zero on return of the pulse, in particular for a duration of at least 40 milliseconds (ms), preferably at least 100 ms, more preferably more than 150 ms, for example between 100 ms and 300 ms.

Thus according to the invention, the power of the disconnection voltage, which is created essentially on the disconnection of the power supply in the form of a negative voltage pulse by being damped on its return to zero Volt, is used to send a current into the coil to deal with the remanence effect. In this way a system is obtained with a simple and reliable structure. In particular, it is no longer necessary, as was the case in the devices of the prior art, to use complicated electronic components, such as DPDT relays (Double Pole, Double Throw) to achieve a reversal of the polarity at the terminals of the coil in order to send a current in opposite direction. In this way it is possible to avoid the formation in particular of sparks (during the sudden switchover of the relays from an open position to the other closed position) which are likely to damage the device, particularly in the case one with a long life cycle. Furthermore, the use of the pulse current sent into the coil at the time of the disconnection makes it possible to ensure a curve showing the intensity of the current in the coil as a function of the time which is continuous, that is without a sudden jump or discontinuity which could lead to the breakdown of the device.

Preferably, means are provided for limiting the maximum absolute value of the voltage disconnection pulse, in particular means in the form of a varistor mounted at the terminals of the at least one coil.

Preferably, however the means for limiting the maximum absolute value limit the absolute value of the maximum voltage to a value greater than the supply voltage.

Preferably, the electric circuit is set up such that the voltage, having passed zero once on return from the peak of the disconnection pulse and possibly damped by the limiting means, in particular the varistor, oscillates around zero while being damped, in particular becoming substantially zero after one or two pulse periods.

Preferably, the layout is such that the device functions even when the polarity of the current source is reversed.

Preferably, the electric circuit comprises at least one non-polarised capacitor and a resistor in series, mounted in parallel at the terminals of the at least one coil of the electromagnet.

According to a particularly advantageous embodiment, in particular in terms of the simplicity of its design and its reliability, the electric circuit comprises a circuit formed by two polarised capacitors in series mounted head to tail, mounted in parallel at the terminals of the at least one coil of the electromagnet.

The present invention also relates to a device forming a door comprising an openable part and a frame and a device forming the electromagnetic lock according to the invention, one of the two elements of the device forming the electromagnetic lock, namely the electromagnetic suction pad and the counter plate, being fixed to the openable part, whereas the other of the two elements is fixed to the frame.

The present invention also relates to a module forming an anti-remanent device for an electromagnetic lock designed to be integrated into an electromagnetic lock and in particular into the electric or electronic control circuit of the electromagnetic lock, the module comprising an electric circuit set up such that the source of current is mounted directly at the terminals of the at least one coil such that when the switching means disconnect the current supply, a disconnection voltage in the form of a pulse is applied to the coil and the electric circuit comprises means for delaying the passage to zero on return of the pulse, in particular for a period of at least 40 milliseconds (ms), preferably at least 100 ms, more preferably more than 150 ms, for example between 100 ms and 300 ms.

According to a particularly advantageous embodiment, particularly in terms of its simplicity of design and its reliability, the electric circuit of the module comprises two polarised capacitors in series, in particular mounted head to tail.

According to another embodiment, the electric circuit of the module comprises a non-polarised capacitor and a resistor in series.

By way of example only embodiments of the invention are described in the following with reference to the drawings in which:

FIG. 1 is a perspective view of a door device comprising a door forming the openable part and a frame encasing the openable part and an electromagnetic lock for ensuring the opening and/or closing of the door;

FIG. 2 is a simplified diagram of the electric control circuit of the current passing into the coil of the electromagnet of the electromagnetic suction pad which controls the opening/closing of the lock of FIG. 1;

FIG. 3 shows the curve showing the voltage at the terminals of the coil as a function of time, from a point in time shortly before the disconnection of the power supply; and FIG. 4 is a diagram of another embodiment of the electric control circuit of the lock of FIG. 1.

FIG. 1 shows a system for opening/closing an entry, comprising an openable part, for example a door P, which depending on its position closes a door opening defined by a door frame, for example a frame D, or alternatively allows access.

The opening/closing of the door is controlled by an electromagnetic lock comprising two elements, an electromagnetic suction pad 3 and a counter plate 1, the electromagnetic suction pad comprises two U-shaped profiles slotted into one another so as to define an closed enclosure inside which an electromagnet 4 is mounted which is designed to create a magnetic field for attracting the counter plate 1 to the electromagnetic suction pad with a force that is greater at least than the maximum force that a human is capable of providing to open the door.

In the closed enclosure defined by the two U-shaped profiles there is also an electric control circuit for the electromagnet, for example mounted on an electronic board.

The electric or electronic circuit comprises a current supply, for example in the form of a battery 2 which according to the application can have a value Vo which can be typically between 8 and 64 Volts, for example 12V, 24V or 48V, designed to pass a magnetisation current into an inductance coil L of the electromagnet. However, said voltage range and said voltage values are only given by way of example, and it would be possible to have other higher values for the voltage without departing from the scope of the invention.

In the present application the electromagnet is described as comprising a single inductance coil. However, this is solely for the purpose of simplifying the description, and it goes without saying that it is possible to provide a plurality of coils forming an equivalent coil which could then be considered to be the said at least one coil of the electromagnet, or provide a plurality of coils and only consider one to be the said at least one coil.

A switch 10 makes it possible to disconnect the circuit. The switch 10 is connected to a control button of the door opening.

Furthermore, a circuit module 22, formed by two polarised capacitors 20 and 21 mounted in series head to tail, is mounted in parallel at the terminals of the inductive resistor L of the electromagnet. The function of said circuit module 22, when the current passing into the coil is disconnected by opening the switch 10, is in the first instance to draw the pulse energy of the disconnection voltage created on opening the switch by charging one of the two capacitors, and discharge the other capacitor to send a current into the coil in the opposite direction of current passing into the coil before opening the switch, to cancel or overcome the remanent magnetic field.

When the switch 10 is closed the door is normally closed and an electric current passes into the coil, which creates a magnetic field. Said magnetic field attracts the counter plate made from ferromagnetic material, for example metal material, against the suction pad and prevents the opening of the door.

When a user is ready to open the door, he can for example press a button (possibly after tapping in an access code) or insert a smart card or the like to activate a circuit which is connected to the switch such that the activation of the button involves opening the switch. The supply of magnetisation current by the battery 2 is then cut off.

Cutting off the power supply by opening the switch creates a disconnection voltage pulse with value of −Vm (cf. FIG. 3).

Preferably, a varistor V is mounted at the terminals of the coil and the module 22 to limit the absolute value Vm of the maximum voltage of the disconnection pulse. However, preferably but without limiting the scope of the invention, Vm is limited to a value greater than V0 (as shown in FIG. 3).

Almost simultaneously with the opening of the switch and the disconnection of the supply of current, the capacitors 20 and 21 perform a charge-discharge cycle which creates a transitory negative current in the coil. Said transitory current, which typically only lasts several milliseconds, has the effect of cancelling or reducing very significantly the remanent magnetic field. As a result the user can open the door without having to overcome the electromagnetic force resulting from the remanent magnetic field. During this charge-discharge cycle, the two capacitors inverse their respective polarities and are immediately available for a new cycle.

For example, for a supply of 12V, respectively 24V, respectively 48V, the current passing into the coil is 500 mA, 250 mA and 125 mA. The internal resistance of the supply can be for example 25, 100, 400 Ohms respectively, without the invention being limited in any way to this value.

The two capacitors, which can be in particular capacitors of the brand Jamicon, have for example a capacity of 1000 microfarads for a nominal voltage of 25V, without the invention being limited in any way to this value.

In is possible to add a resistor R to the circuit 22. However, this is an optional feature. Furthermore, it is preferable not to position it between the two capacitors 20 and 21.

The characteristic value of the inductance is for example 2800 H/24 Volts, without the invention being limited in any way to this value.

FIG. 3, shows the curve illustrating the voltage at the terminals of the coil L several moments prior to the opening of the switch 10.

Said curve is continuous, i.e. it does not include any discontinuity such as sudden jumps from the disconnection of the switch to to.

At moment to, the user is pressing the opening button of the door, setting the switch into the open state. The voltage at the terminals of the coil then drops very rapidly creating a voltage pulse (in the order of 1 ms) up to a value Vm. This is a typical phenomenon of disconnection voltage.

The varistor V limits the value Vm.

The action of the modules 22 or 22" in FIGS. 2 and 4 respectively has the effect of slowing down the rise of the curve (relative to a typical disconnection voltage pulse) such that the voltage only becomes zero for the first time at the end of a period of time ΔTo, which is at least 40 ms, preferably at least 100 ms, more preferably at least 150 ms, in particular between 120 ms and 300 ms. A current is thus created in the coil which is sufficient to cancel the residual or remanent magnetism.

In the preferred case where Vm is greater than Vo (for example between 1.5 times and 3 times Vo) the electric circuit (particularly if it comprises one of the modules 22 or 22") is such that the voltage returns to the value −Vo at the end of a time period Δto that is greater than 40 ms, in particular greater than 70 ms.

In this way the remanence effect is cancelled in a period of in the order of a tenth to several tenths of a second, which is imperceptible to the user, who therefore does not have the impression of overcoming a force to open the door. Then, the damping of the sinusoidal form is performed in several oscillations, in a period of several milliseconds.

Furthermore, after passing to zero at to+Δto, the voltage is absorbed in a sinusoidal manner around zero. In particular, the half period of oscillation (Δt1-ΔTo in FIG. 3) is in the order of 100 ms. At the end of an oscillation period the voltage is almost zero.

FIG. 4 shows a diagram of another electric circuit, in particular an electronic circuit, for controlling the current passing into the coil of the electromagnet.

To form the electric current, a source of current is used in the form of a battery 2 of nominal voltage of for example 12V, 24V or 48V. The current passing into the coil is 500 mA, 250 mA and 125 mA. The internal resistance of the supply can be for example 25, 100, 400 Ohms respectively, without the invention being limited in any way to this value. The characteristic value of the inductive resistor is for example 2800 H/24 Volts, without the invention being limited in any way to this value.

Furthermore, a circuit module 22" in the form of a non-polarised capacitor 34 and a resistor R' mounted in series is mounted at the terminals of the inductive resistor, in parallel with the latter.

The function of this circuit module 22, when the current passing into the coil is disconnected by opening the switch 10, is in the first instance to draw the pulse energy of the disconnection voltage created by opening the switch by charging one of the two capacitors, and to discharge the other capacitor to send a current into the coil in the opposite direction of the current passing into the coil before opening the switch, to nullify or overcome the remanent magnetic field.

The capacitor 34 and the resistor R' can, for example and without the invention being limited to said values, have respective characteristic values of 25V/1004 μF and 100 Ohms.

The curve showing the intensity passing into the coil L from several moments prior to the opening of the switch has a form identical to that shown in FIG. 3 for the circuit of FIG. 2 and has the same characteristics.

In particular, from point to, the moment of opening the switch, the intensity reduces following a gradient such that the current becomes zero at the end of a period of time of several milliseconds. Once the intensity has been nullified all of the energy of the coil has been recovered by the module 22" and the capacitor 34 discharges through the resistor R' until the current reaches the lowest point of the curve. At this moment, of about several milliseconds, the remanence is then cleared and the door opens without difficulty. Then, the same cycle as above starts again, but is much damped, during several oscillations, before the final elimination of the current.

In the figures, in the embodiment described the counter plate is fixed to the openable part and the suction pad to the door frame. However, according to another embodiment forming part of the scope of protection of the present invention it is possible to have a reverse arrangement.

Furthermore, for both the assembly in FIG. 2 and FIG. 4, the system functions in the same way when the polarities of the current source 2 are reversed, only the directions of the magnetisation and anti-remanent currents are reversed respectively.

The invention claimed is:

1. Device forming an electromagnetic lock comprising an electromagnetic suction pad (3) comprising an electromagnet (4), a counter plate (1) and an electric circuit comprising a source (2) of current designed to supply at least one coil (L), having terminals, of the electromagnet of the electromagnetic suction pad with an electric magnetisation current to create an electromagnetic field and an associated electromagnetic force pinning the counter plate and the electromagnetic suction pad against one another to close the lock; switching means (10) designed to disconnect the current supply; and anti-remanent means designed to deal with any remanent electromagnetic force which remains when the switching means (10) have disconnected the source (2) of the current supply to the at least one coil characterised in that the electric circuit is set up such that the source (2) of the current supply is mounted directly at the terminals of the at least one coil (L) such that when the switching means (10) disconnects the supply of current, a disconnection voltage (−Vm) in the form of a negative pulse appears at the terminals of the at least one coil and the electric circuit comprises means (22; 22") designed to delay a switchover to zero on return of the pulse, for a duration of more than 150 milliseconds (ms).

2. Device according to claim 1, characterised in that means are provided for limiting a maximum absolute value of the voltage disconnection pulse, wherein said means for limiting are in the form of a varistor mounted at the terminals of the at least one coil.

3. Device according to claim 2, characterised in that the means for limiting the maximum absolute value limit a absolute value of a maximum voltage to a value greater than a supply voltage.

4. Device according to claim 1, characterised in that the electric circuit is setup such that a voltage having passed zero once on return from a peak of a disconnection pulse and potentially damped by a limiting means oscillates around zero while being dampened, becoming zero after one or two pulse periods.

5. Device according to claim 1, characterised in that the electric circuit comprises at least one capacitor (20, 21; 34).

6. Device according to claim 5, characterised in that the electric circuit comprises two polarised capacitors (20, 21) anti-series mounted.

7. Device according to claim 6, characterised in that the two capacitors (20, 21) in anti-series are mounted in parallel with source (2) of current.

8. Device according to claim 6, characterised in that the two capacitors (20, 21) in anti-series are mounted in parallel with the at least one coil (L) of the electromagnet (4) of the suction pad.

9. Device according to claim 5, characterised in that the electric circuit comprises a non-polarised capacitor (34) mounted in series with a resistor (R'), mounted in parallel with the at least one coil (L).

10. Device according to claim 1, characterised in that it comprises two polarised capacitors mounted in series.

11. Device according to claim 10, characterised in that the two capacitors are mounted in anti-series.

12. Device forming a door comprising an openable part (P) and a frame (D) and a device forming an electromagnetic lock according to claim 1, one of the electromagnetic suction pad (3) or the counter plate (1), being fixed to the openable part, and the other of either the electromagnetic suction pad (3) or the counter plate (1) being fixed to the frame.

13. Device forming an electromagnetic lock comprising an electromagnetic suction pad (3) comprising an electromagnet (4), a counter plate (1) and an electric circuit comprising a source (2) of current designed to supply at least one coil (L), having terminals, of the electromagnet of the electromagnetic suction pad with an electric magnetisation current to create an electromagnetic field and an associated electromagnetic force pinning the counter plate and the electromagnetic suction pad against one another to close the lock; switching means (10) designed to disconnect the current supply; and anti-remanent means designed to deal with any remanent electromagnetic force which remains when the switching means (10) have disconnected the source (2) of the current supply to the at least one coil, characterised in that the electric circuit is set up such that a curve illustrating a voltage at the terminals of the at least one coil after disconnection of the source (2) of the current supply drops so as to create a negative voltage pulse (−Vm) and then rises to become zero for a first time at the end of a period of time (ΔTo) which is at least 40 milliseconds and then up to a first local maximum and then decreases back to oscillate around zero before becoming zero.

14. Device forming an electromagnetic lock comprising an electromagnetic suction pad (3) comprising an electromagnet (4), a counter plate (1) and an electric circuit comprising a source (2) of current designed to supply at least one coil (L), having terminals, of the electromagnet of the electromagnetic suction pad with an electric magnetisation current to create an electromagnetic field and an associated electromagnetic force pinning the counter plate and the electromagnetic suction pad against one another to close the lock; switching means (10) designed to disconnect the current supply; and anti-remanent means designed to deal with any remanent electromagnetic force which remains when the switching means (10) have disconnected the source (2) of the current supply to the at least one coil characterised in that the electric circuit is set up such that the source (2) of the current supply is mounted directly at the terminals of the at least one coil (L) such that when the switching means (10) disconnects the supply of current, a disconnection voltage (−Vm) in the form of a negative pulse appears at the terminals of the at least one coil and the electric circuit comprises means (22; 22") designed to delay a switchover to zero on return of the pulse, for a duration of more than 40 milliseconds (ms).

* * * * *